US005655175A

United States Patent [19]

Oshida

[11] Patent Number: 5,655,175

[45] Date of Patent: Aug. 5, 1997

[54] DEVELOPING APPARATUS HAVING LIGHT TRANSMITTING WINDOW

[75] Inventor: Haruhisa Oshida, Hatogaya, Japan

[73] Assignee: Canon Kabushiki Kaisha, Tokyo, Japan

[21] Appl. No.: 684,625

[22] Filed: Jul. 22, 1996

Related U.S. Application Data

[63] Continuation of Ser. No. 347,098, Nov. 23, 1994, abandoned.

[30] Foreign Application Priority Data

Nov. 25, 1993 [JP] Japan ..... 5-317547

[51] Int. Cl.[6] ..... G03G 15/08; G03G 21/00

[52] U.S. Cl. ..... 399/27; 250/577

[58] Field of Search ..... 399/27; 118/694; 250/577; 340/617, 619; 355/203, 206

[56] References Cited

FOREIGN PATENT DOCUMENTS 63-2087 1/1988 Japan ..... 355/203

OTHER PUBLICATIONS

Japanese patent abstract—vol. 014, No. 124 (p–1018), 8 Mar. 1990 & JP 01 319065 (Canon Inc), 25 Dec. 1989.

Japanese patent abstract—vol. 013, No. 228 (p–877), 26 May 1989 & JP 01 038779 A (Minolta Camera Co Ltd), 9 Feb. 1989.

*Primary Examiner*—Joan H. Pendegrass

*Attorney, Agent, or Firm*—Fitzpatrick, Cella, Harper & Scinto

[57] ABSTRACT

A developing apparatus includes a developer container for containing a developer; a light transmitting portion, in the developer container, for optically detecting the developer; a rotatable wiping sheet for wiping the light transmitting portion; wherein the wiping sheet has a low rigidity portion at a rotational axis side beyond an end of the wiping sheet.

16 Claims, 17 Drawing Sheets

(a)

(b)

DEVELOPING APPARATUS HAVING LIGHT TRANSMITTING WINDOW

This application is a continuation of application Ser. No. 08/347,098 filed Nov. 23, 1994, now abandoned.

FIELD OF THE INVENTION AND RELATED ART

The present invention relates to a developing apparatus for developing an electrostatic latent image on an image bearing member usable with an image forming apparatus such as an electrophotographic apparatus, electrostatic recording apparatus or the like.

It is conventional that a beam is introduced into a developer container for containing a developer, and that light transmitted through the container is detected to determine the presence or absence of developer therein.

Referring first to FIGS. 21 and 22, there is shown an example of such an apparatus. FIG. 21 shows a light transmitting type apparatus, wherein reference numerals 115 and 116 designate a light emitting element and light receiving element, respectively. A developer container 125 is provided with a transparent window 126*a* and a transparent window 126*b* for transmitting light at respective positions corresponding to light emitting element 115 and light receiving element 116.

When a sufficient amount of developer is contained in the developer container 125, light from the light emitting element 115 which enters the developer container 125 through transparent window 126*a*, is blocked by the developer therein, so that the light will not reach the light receiving element 116. When the developer container becomes sufficiently empty by consumption of the developer, then light from the light emitting element 115 will reach the light receiving element 116 through the transparent window 126*a* and transparent window 126*b*. In this manner, the presence or absence of developer is detected on the basis of the change of the output of the light receiving element 116.

FIG. 22 is an enlarged view of a cleaning member 129 for cleaning the windows 126(*a*), 126(*b*). It is rotatable about shaft 129*a* by an unshown driving source. A cleaning blade 128 composed of flexible material is mounted to a tip end of the cleaning member 129 and is brought into contact with the inside surfaces of the transparent window 126*a* and transparent window 126*b* and wipes off any developer T thereon, by rotation of the cleaning member 129. By doing so, erroneous determinations of the presence of developer due to contamination of the windows may be avoided in the absence of any developer.

As one of various factors influential to the cleaning of the windows, there is a contact angle θ between the cleaning blade 128 and the window surface. If the contact angle is small, then the angle of the force applied to the window surface is close to 90 degrees, and as shown in FIG. 23 (*a*), the cleaning blade 128 presses the toner particles to the window surface and rides over them, with the result that the toner remains on the window surface. Therefore, the cleaning action is not very effective. So, the contact angle is preferably 90 degrees. However, if the contact angle is very close to 90 degrees, then the blade will not reach the window surface if it is even slightly shorter than required, resulting in the possibility of inadequate cleaning. Thus the positioning between the window surface and the blade must be highly accurate. This increases the manufacturing Cost of the apparatus. Additionally, if the contact angle is very close to 90 degrees, and if the blade is deformed even slightly by the resistance caused by the scraping action, then the cleaning of the window becomes impossible.

Therefore, it is required that a sufficient entrance amount d of the blade and contact angle θ are determined in consideration of the positional accuracy and deformation of the apparatus.

On the other hand, the recent demand is directed to downsizing the developing apparatus. To meet this, a flat developing apparatus is proposed from the standpoint of space saving or for a small size cartridge.

When the size of the developing apparatus is reduced, the entrance amount of the blade d has to be reduced, resulting in the following problems. In order to provide the sufficient cleaning effects, d>0 is required even if the d is small, and therefore, the positional precision is required, which leads to an increase in the cost. If the entrance amount is too large, then the contact angle becomes small, and the cleaning effects are deteriorated. Furthermore, the deformation of creating a blade increases, the difference in the torque required when the blade is cleaning the window surface and that when the blade is out of contact with the window surface. This increases the variation of the torque during the image forming operation with the possible result of a deterioration in the quality of the resultant image.

SUMMARY OF THE INVENTION

Accordingly, it is a principal object of the present invention to provide a developing apparatus wherein a transparent window can be effectively cleaned.

It is another object of the present invention to provide a developing apparatus wherein a difference in the driving torque between a cleaning operation and non-cleaning operation is minimal.

According to an aspect of the present invention, there is provided a developing apparatus comprising: a developer container for containing a developer; a light transmitting portion in the developer container, which is used for optically detecting the developer; and a rotatable wiping sheet for wiping the light transmitting portion; wherein the wiping sheet has a low rigidity portion at a rotational axis side beyond an end of the wiping sheet.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENT

Referring to FIGS. 1–11, an embodiment of the present invention will be described. The exemplary image forming apparatus in the embodiment is an electrophotographic type facsimile machine.

Figure 1:
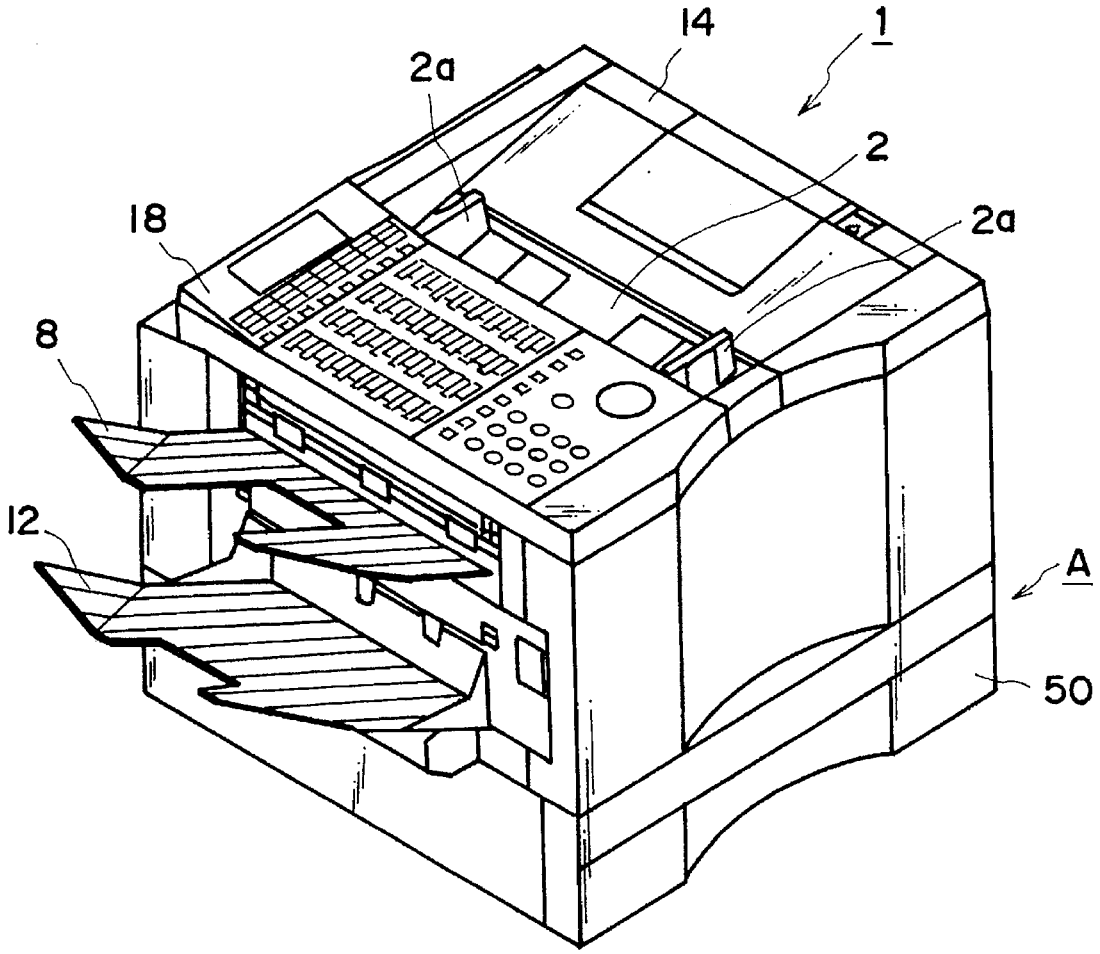
FIG. 1 is a perspective view of an image forming apparatus according to an embodiment of the present invention.
Figure 2:
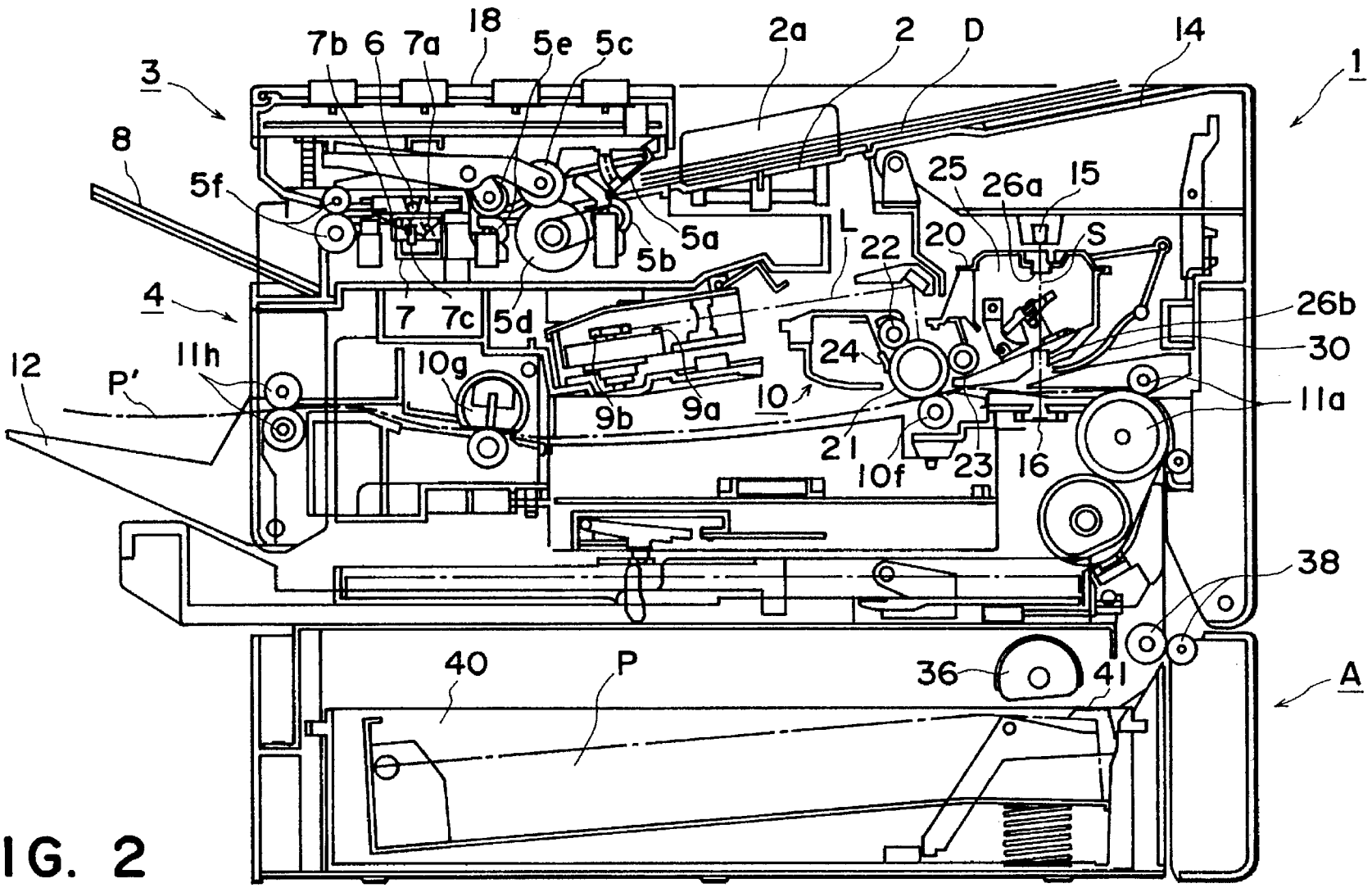
FIG. 2 is a longitudinal sectional view of an image forming apparatus of embodiment 1.
Figure 3:
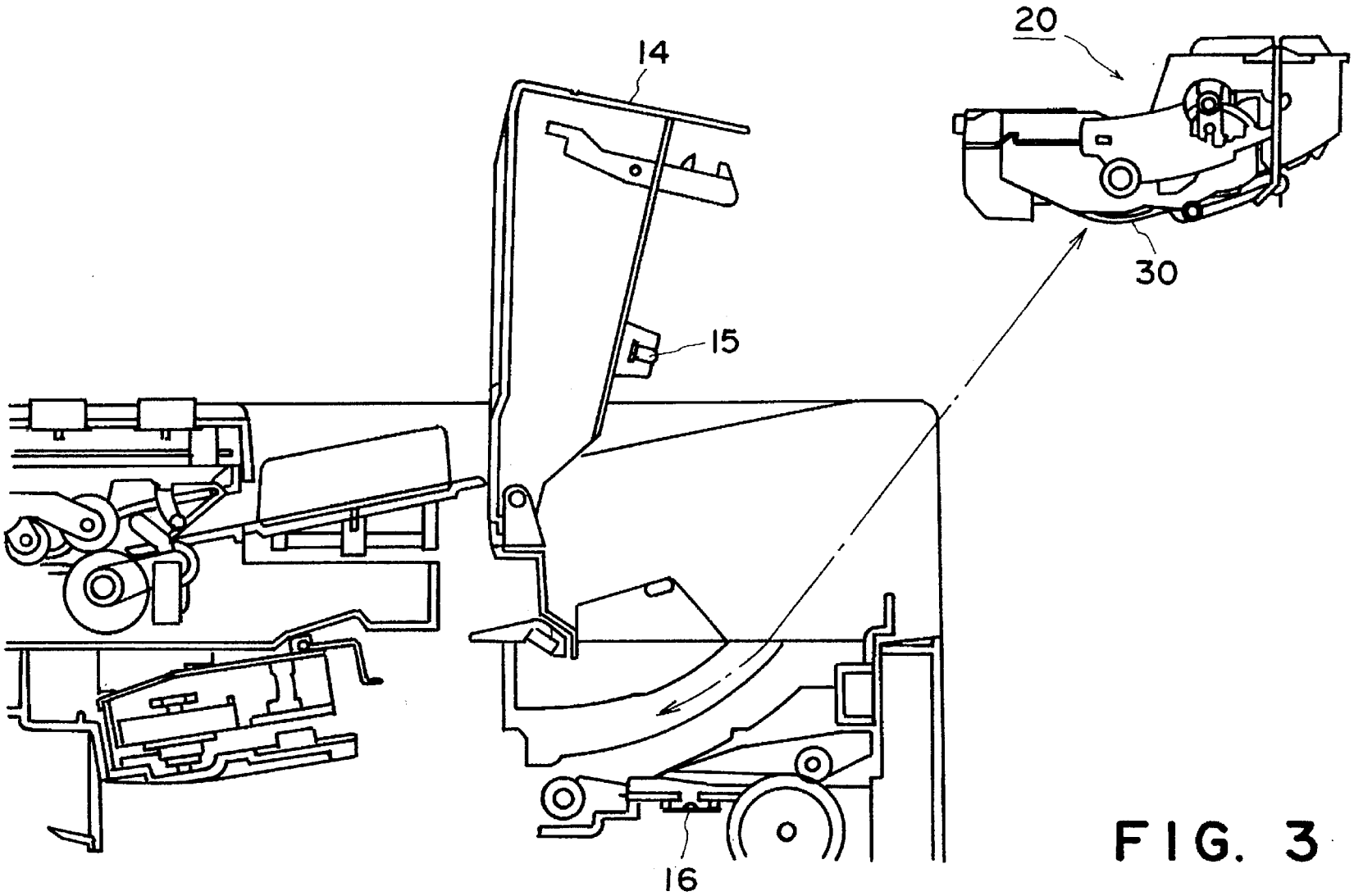
FIG. 3 illustrates an operation of mounting and demounting a process cartridge relative to the image forming apparatus of embodiment 1.

In FIGS. 1 and 2, a top cover of the main assembly of the apparatus 1 is constructed to permit placement of a stack of original documents thereon. Adjacent one end of the top surface (left-hand side in FIG. 2), an optical reader 3 for reading image information of an original fed from the original platen 2, above the reader 3, and an operation panel 18 are provided. Below the reader 3, a recording system comprising a laser beam printer is located.

The optical reader 3 separates one by one the originals D on the original platen 2 by a prefeeding roller 5*b* press-contacted to a prefeeding pressing member 5*a* and a separation roller 5*d* press-contacted to a reversing roller 5*c*, and feeds such single originals to a contact sensor by original feeding roller pair 5*e* or the like. The image information of the original D is read while an urging means presses the original D onto the contact sensor 7, and thereafter, the original D is discharged to the discharge tray 8 by discharging pair of rollers 5*f*.

The contact sensor 7 emits light according to the image information of the originals from an LED 7*a* functioning as a light source, and light reflected thereby is imaged on a photo-electric converter 7*c* through a short focus imaging lens 7*b*. The read information is transmitted to a recording station of another machine in a facsimile mode and is transmitted to an integral recording system in a copy mode.

Original platen 2 is provided with a slider 2*a* slidable in a direction perpendicular to a feeding direction of an original (width direction of the original D). The slider 2 is operated to meet the width of the originals to align the lateral edges of the originals.

A laser beam oscillator 9*a* of the recording system 4 emits a laser beam modulated in accordance with the image signals of the contact sensor 7, and the modulated beam is deflected by a polygonal mirror 9*b* and is directed to a photosensitive drum 21 in an image forming station as image light. The image information is converted to a toner image, which in turn is transferred onto a recording sheet p', and fixed thereon. Then, the recording sheet p' is discharged. The photosensitive drum 21 is integrally contained in a process cartridge 20 together with a primary charger 22, a developing device 23, a cleaner 24 and a developer container 25 for containing a developer T, and the process cartridge is detachably mountable to the main assembly 1 of the apparatus.

The image forming operation now will be described. The surface of the photosensitive drum 21 (image bearing member) is uniformly charged by the primary charger 22, and is subjected to the image light L from the laser beam oscillator 9*a*, by which an electrostatic latent image is formed on the photosensitive drum 21. The electrostatic latent image is visualized (developed) into a toner image by developer (toner T) supplied from the developing device 23. The toner image on the photosensitive drum 21 is transferred onto a recording sheet p' fed from a sheet feeder A, by a transfer charger 10 disposed adjacent to the photosensitive drum 21. The recording sheet p' now carrying the toner image is subjected to image fixing by an image fixing device 10*g* so that the toner image is fixed on the sheet. Then, the sheet is discharged via a pair of rollers 11*h* to a discharge tray 12 detachably mounted to a side of the apparatus (left side in FIGS. 2 and 3). On the other hand, the photosensitive drum 21, after the image transfer operation, is cleaned by the cleaner 24 so that any residual toner or the like is removed, thus preparing for the next image forming operation.

On the original platen 2, there is an openable cover. When it is opened, process cartridge 20 can be removed and exchanged.

The process cartridge 20 is provided with a shutter 30 for shielding it from light. The shutter 30 automatically opens when the process cartridge is mounted in the apparatus, and the shutter 30 automatically closes when it is taken out of the apparatus.

A light emitting element 15 is mounted on an inside surface of the top part, and a light receiving element 16 is mounted on the main assembly of the apparatus. They are disposed such that when the process cartridge 20 is mounted to the main assembly 1 and the cover 14 is closed, they face each other with the developer container 25 therebetween, The developer container 25 is provided with a transparent window 26*a* and a transparent window 26*b* interposed between the light emitting element 15 and light receiving element 16.

The detecting light emitted by light emitting element 15 is directed into the developer container 25 through the transparent window 26*a*. When the developer container 25 contains a sufficient amount of the developer T, the light is blocked by the developer T. When the developer container 25 does not contain a sufficient amount of the developer T, the light passes through the transparant window 26*b* to the outside of developer container 25 to reach the light receiving element 16, so that the absence of the developer T can be detected.

In the sheet feeding station A, a topmost one of the sheets stacked on a cassette 40, which is retractable from one side of the bottom portion of the apparatus, is fed out by cooperation of separation claws 41 at the front corners and a crescent pick-up roller 36. The sheet is then fed to a feeding roller to a pair of registration rollers, and by a pair of feeding rollers 38. The registration rollers feeds the sheet, in timed relation with the leading edge of the toner image on the photosensitive drum 21, to the image transfer position formed by a transfer charger 10*f* and the photosensitive drum 21.

Figure 4:
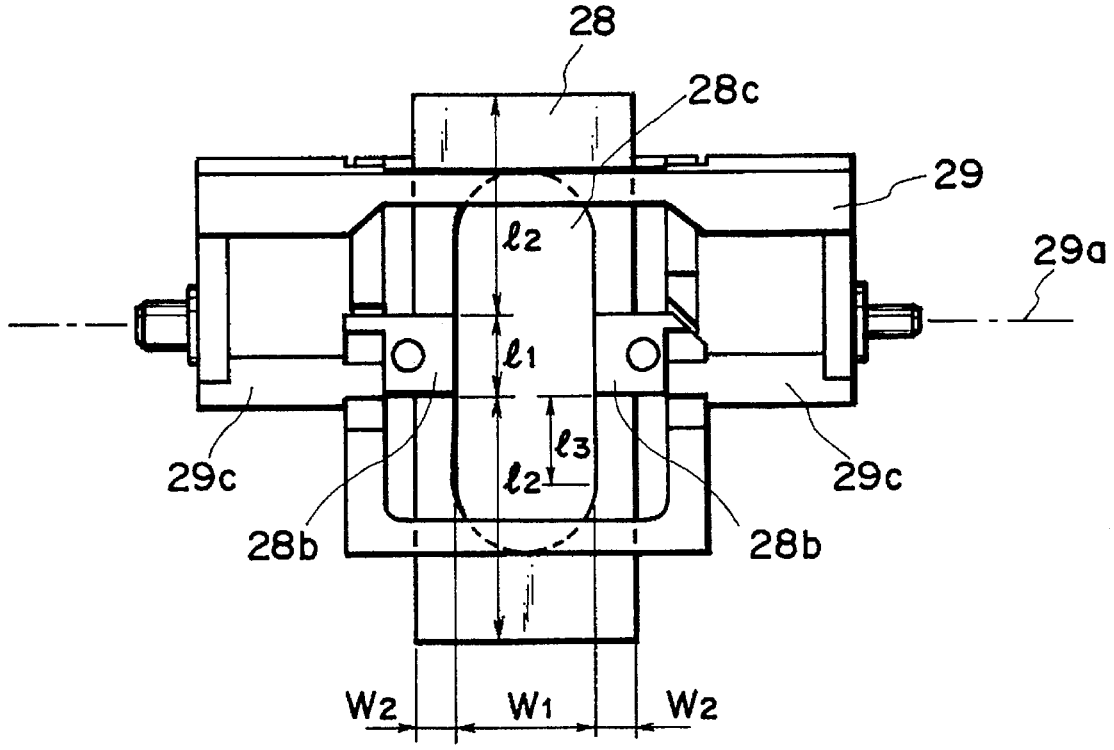
FIG. 4 is a front view of a cleaning member used in the apparatus of embodiment 1.
Figure 5:
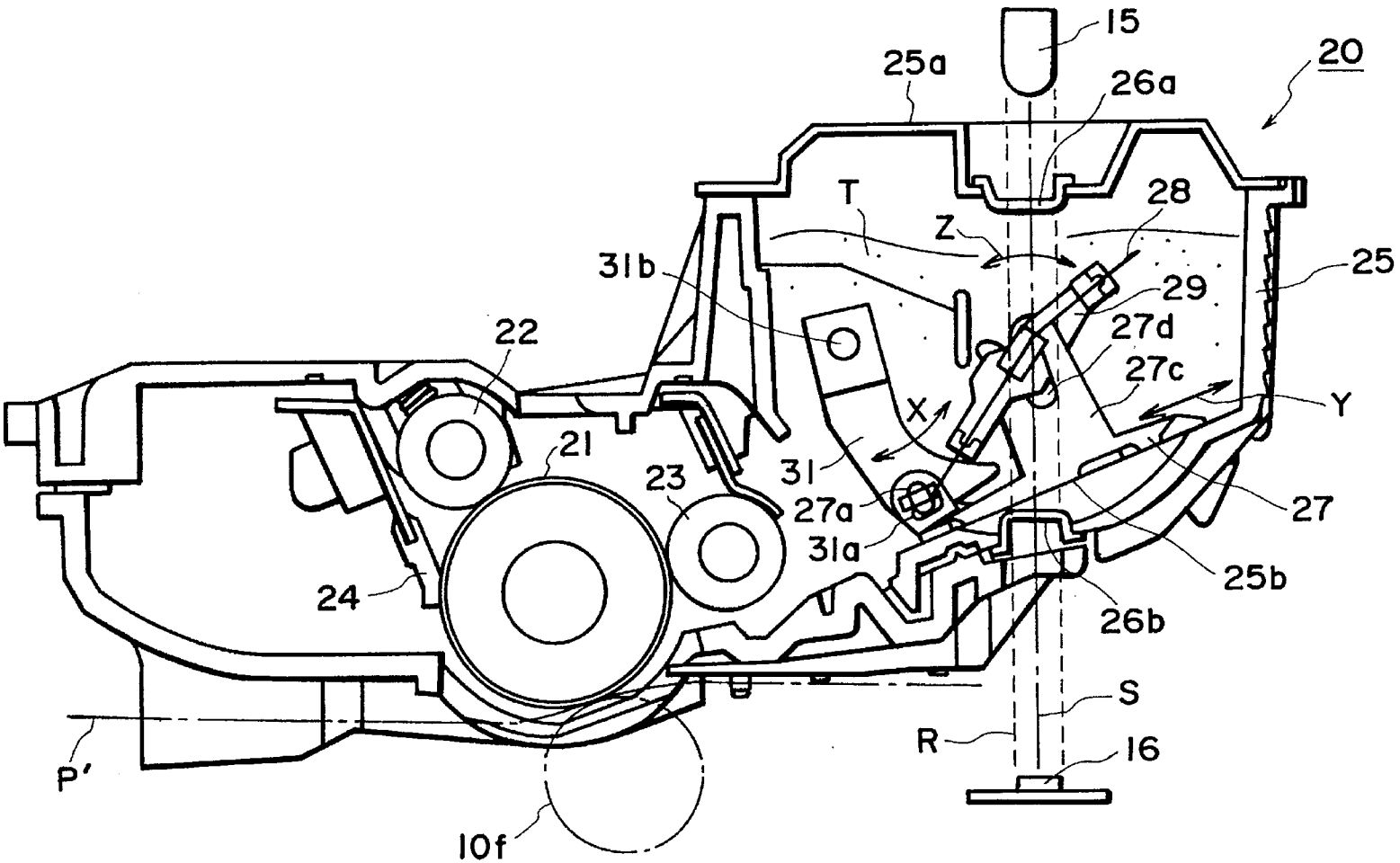
FIG. 5 is a longitudinal sectional view of a process cartridge according to embodiment 1.
Figure 6:
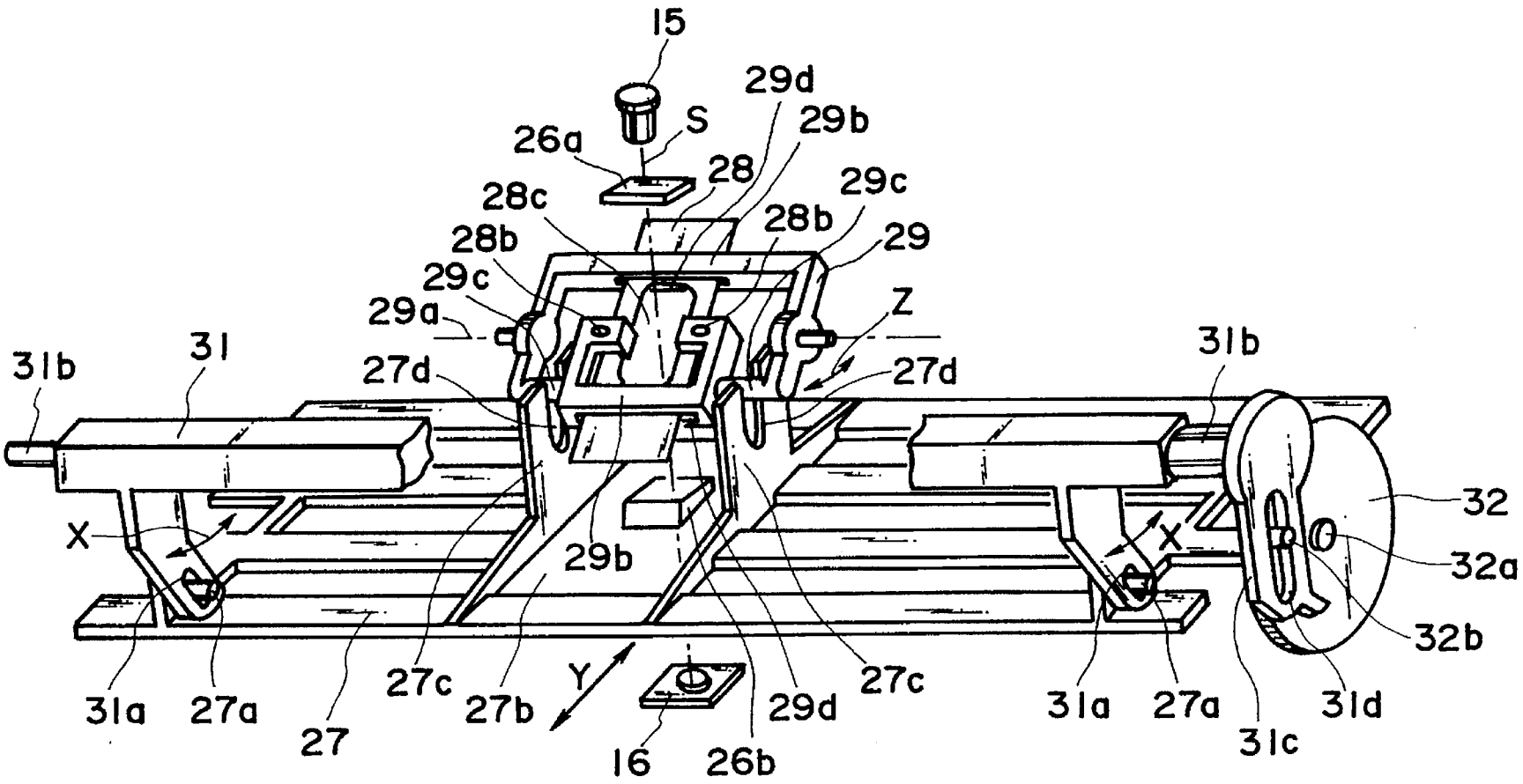
FIG. 6 is a perspective view of a major portion of a process cartridge according to embodiment 1.

Referring to FIGS. 4–11, the description will be made as to a developer detection device for detecting the absence or presence of the developer. FIG. 4 is a front view of a cleaning member according to an embodiment of the present invention FIGS. 5 and 6 are a longitudinal sectional view and a perspective view of a major part of the developer detector.

The light emitting element 15 and light receiving element 16 are mounted on the main assembly 1 so that they are facing to each other. Designated by S is an optical axis therebetween, and R is an optical path of the detecting light incident on the light receiving element 16.

The transparent window 26*a* and the transparant window 26*b* respectively are formed in a top wall 25*a* and a bottom wall 25*b* of the developer container 25. Here, "transparent" means transparant relative to the light or beam emitted by the light emitting element 15, and does not necessarily means "visually transparent".

A stirring blade 27 and a stirring arm 31 are provided in the developer container 25. A shaft 27*a* adjacent an end of the stirring blade 27 is engaged with a hole 31*a* of stirring arm 31. Stirring blade 27 has an opening 27*b* so as not to interfere with the optical path R, and ribs 27*c* provided with U-grooves are formed at both sides thereof. Stirring arm 31 is rotatably supported on a shaft 31*b* on a side of the developer container 25. An end thereof extends outwardly from the side of the developer container 25, and an end portion thereof is provided with an integral driving arm 31*c*.

A stirring gear 32 is mounted to the outside of developer container 25, and rotates about shaft 32*a* with the rotation of the photosensitive drum 21. A pin 32*b* is eccentrically located relative to a shaft 32*a*, and is engaged with a hole 31*d* of the driving arm 31*c*.

When the stirring gear 32 rotates with rotation of the photosensitive drum 21, the stirring arm 31 reciprocates in direction X about the shaft 31*b*. The stirring blade 27 reciprocates in direction Y along the bottom of the developer container 25 to feed the developer T into a developing chamber and prevents agglomeration of the developer T or the non-uniform distribution of the developer T in the developer container 25. The bottom wall 25*b* of the developer container 25 is slanted toward the developing chamber to assist the supply of developer T to the developing chamber.

A cleaning member 29 is provided for cleaning the transparent window 26*a* and transparant window 26*b*, and is rotatably supported on shaft 29*a*. A driving shaft 29*c* is eccentrically located relative to shaft 29*a*, and is engaged in the U-groove of the stirring blade 27.

When the stirring blade 27 reciprocates in the direction Y, the driving shaft 29*c* receives a driving force from a rib 27*c*, to reciprocally swing the cleaning member 29 about shaft 29*a* in a direction Z. The angle of the swinging motion is preferably less than 100 degrees to permit smooth sliding between driving shaft 29*c* and rib 27*c*.

A cleaning blade 28 is provided in the form of a wiping sheet of flexible material, and is fixed on the cleaning member 29 on substantially a central portion 28*b* of the cleaning blade 28. The opposite end portions are extended out through slits 29*d* formed in the end portions 29*b* of the cleaning member 29.

An opening 28*c* is formed in the cleaning blade 28 so that the cleaning blade 28 continues to block the optical path R. By doing so, the optical path R is blocked only by the the end portion 29*b* and the cleaning blade 28, despite the fact that the shaft 29*a* is disposed at a position blocking the optical axis. Therefore, the presence or absence of developer T can be detected when the end portions 29*b* or the cleaning blade 28 blocks the optical path R.

Figure 7:
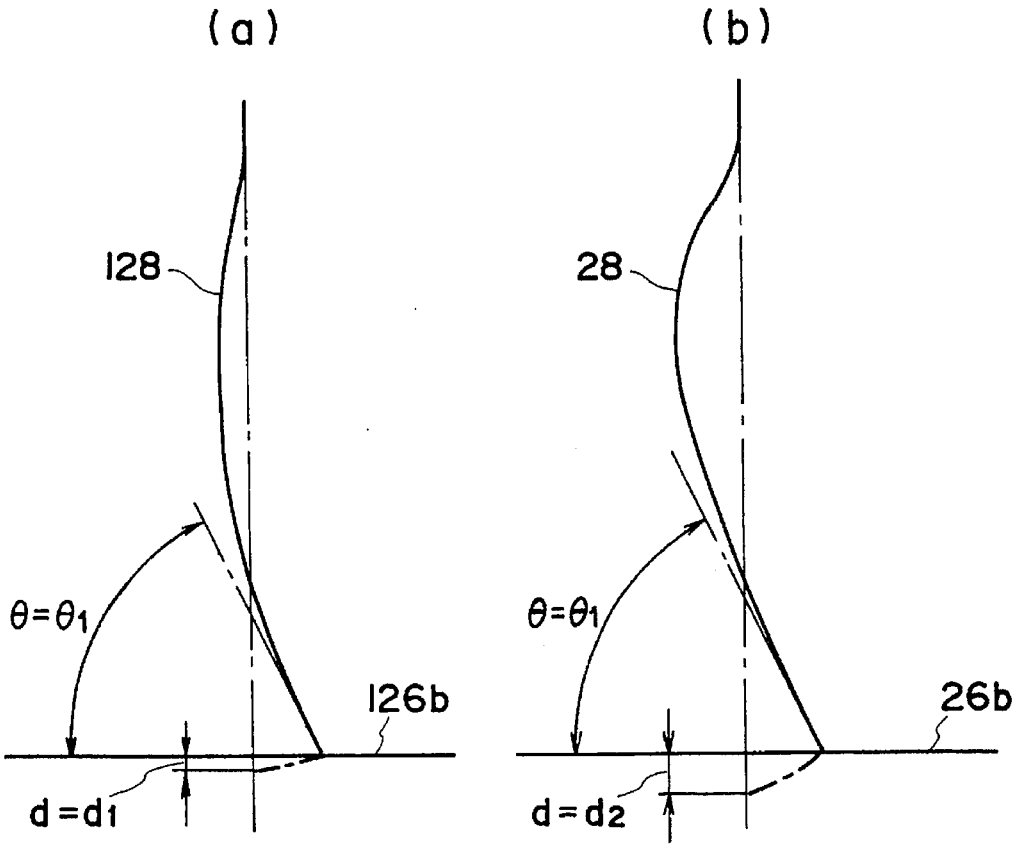
FIGS. 7(*a*) and 7(*b*) illustrates a modified example of the cleaning blade in embodiment 1.
Figure 8:
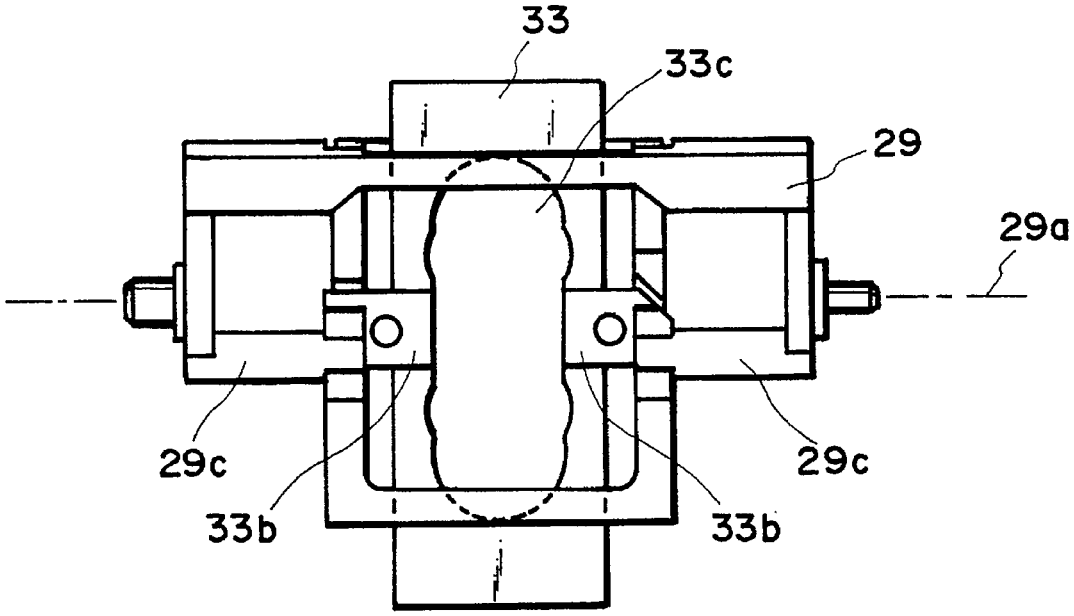
FIG. 8 shows a cleaning blade used in embodiment 1.
Figure 21:
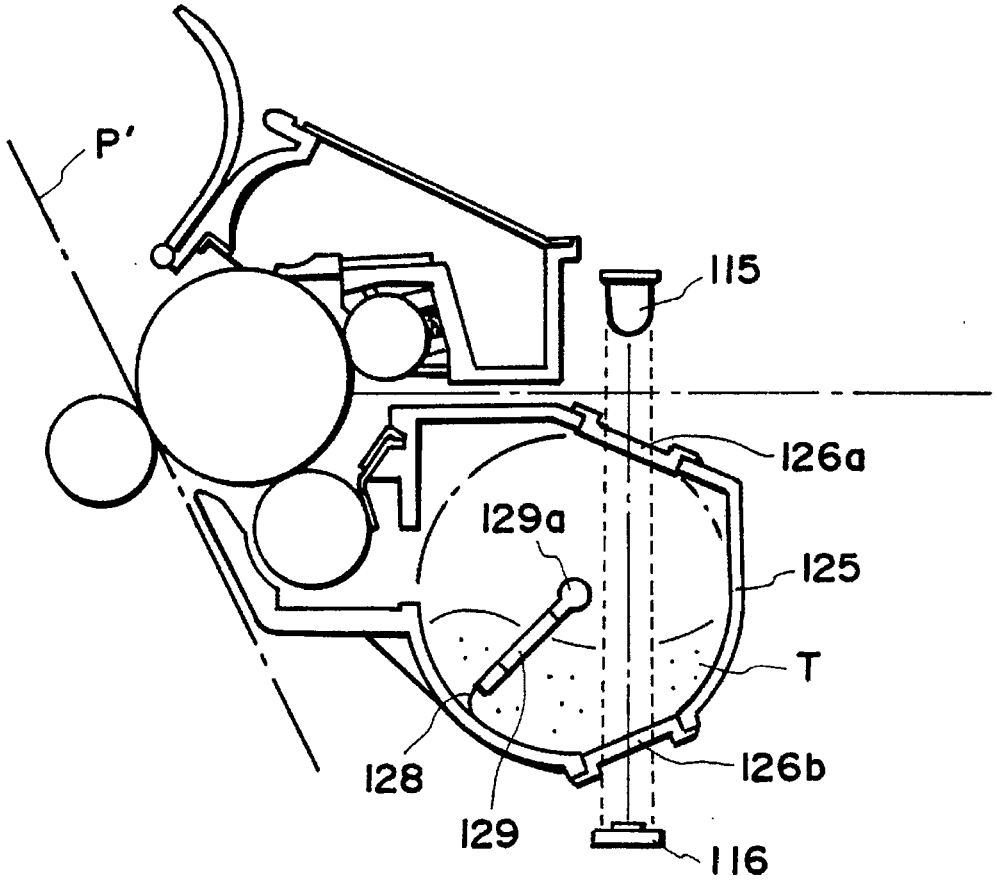
FIG. 21 PRIOR ART
FIG. 21 is a longitudinal sectional view of a process cartridge.
Figure 22:
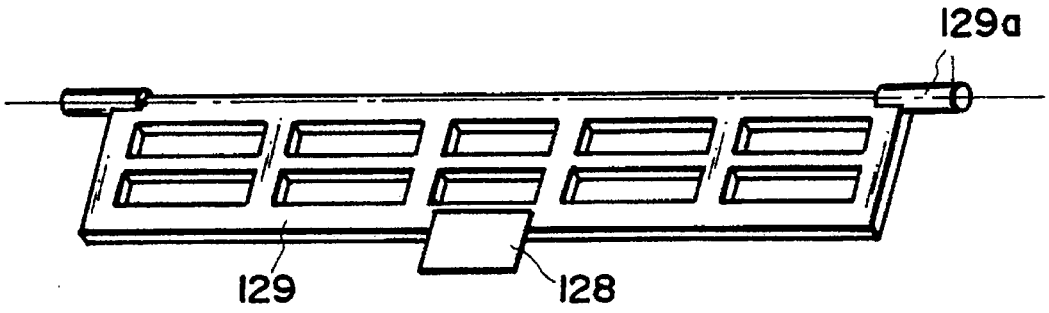
FIG. 22 PRIOR ART
FIG. 22 is a perspective view of stirring blades used in FIG. 21 structure.
Figure 23A:
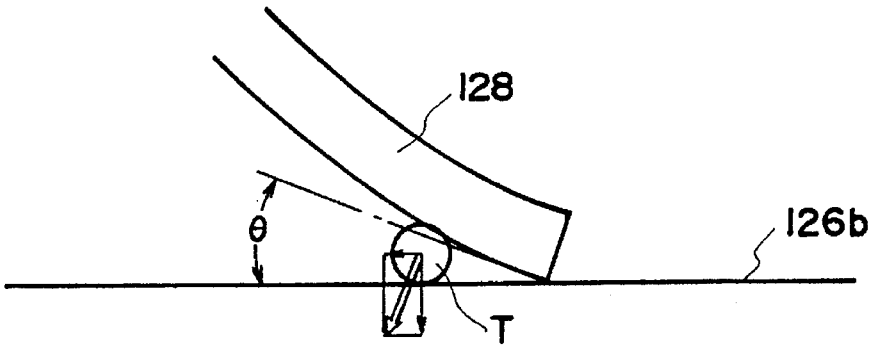
FIG. 23(a) PRIOR ART
FIGS. 23(*a*) and (*b*) shows a relationship between the contact angle of the cleaning blade and the wiping force for the developer.
Figure 23B:
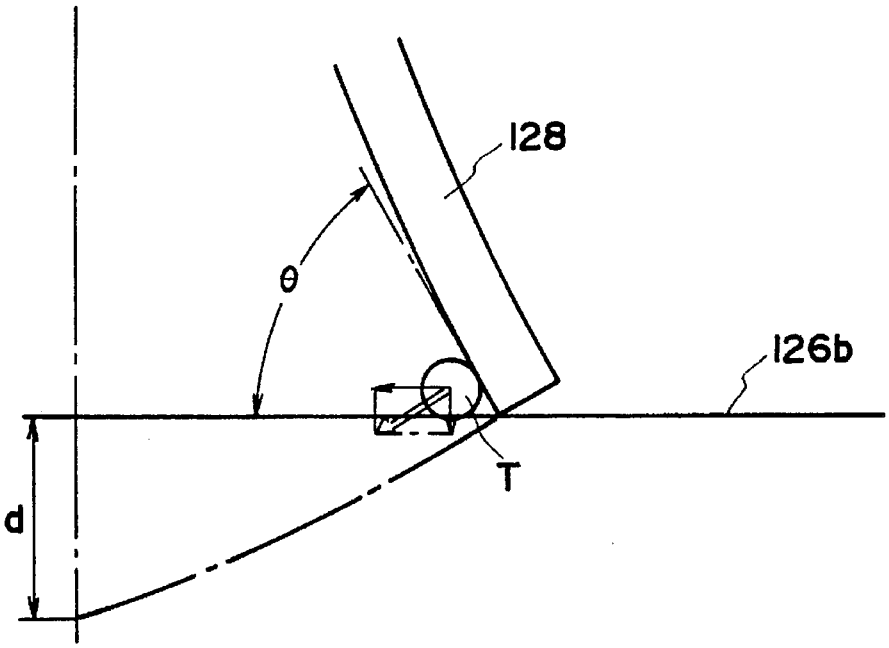
FIG. 23(b) PRIOR ART

FIG. 7 shows a comparison between a modification of the cleaning blade shown in FIG. 21 and that of this embodiment. When the positional relations between the cleaning member and the transparent window are the same, the cleaning blade deforms significantly adjacent opening 28*c* as shown in FIG. 7 (*b*) because of the provision of the opening 28*c* in the cleaning blade in this embodiment. The deformation in the other position is less. As a result, the entrance amount d required to provide a contact angle $\theta=\theta 1$ as in FIG. 21 can be increased, that is, $d2>d1$. For this reason, even if the cleaning member 29 is made smaller for the purpose of downsizing the apparatus, the entrance amount d is not required to be correspondingly reduced at the same proportional ratio, and positional accuracy is not required to be increased.

By fixing cleaning blade 28 at the substantially central portion 28*b* of the cleaning blade, the length of the free portion of the cleaning blade can be increased as compared with the case wherein downsizing is accomplished by mounting a short cleaning blade 128 on the end of the cleaning member 129. In addition, the opening 28*c* is effective to decrease the rigidity of the cleaning blade 28, and therefore, the rigidity of cleaning blade 28 can be reduced to maintain a low resistance against deformation of the cleaning blade 28. Because of this, there is no need increasing the driving torque of the apparatus, and there is no potential for deteriorating the image quality. In addition, the integral structure of the two blades decreases the number of assembling steps.

The rigidity of the deforming portion of the cleaning blade 28 can be controlled relatively freely by changing the fixed length l1, that is, by changing the free length l2, or by changing the width w1 of the opening 28*c*, that is, the width w2 of the narrow portion of the cleaning blade. Alternatively, shown in FIG. 8, the opening 33*c* of the cleaning blade 33 may take such a configuration that the deformation of the cleaning blade is more concentrated.

Thus, by changing the configuration of the opening of the cleaning blade, the contact pressure and the contact angle between the window surface and the cleaning blade can be determined to provide the satisfactory cleaning. Therefore, the design latitude for the entrance amount or the mounting position of the cleaning blade or another structure can be increased.

Figure 9:
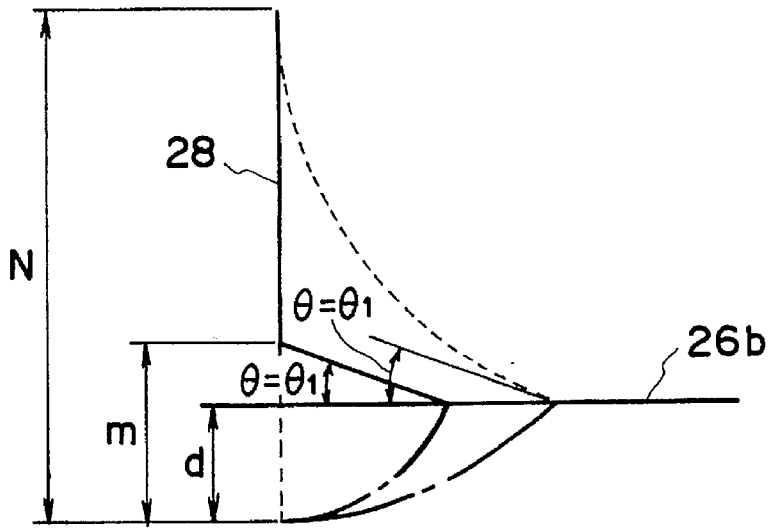
FIGS. 9(*a*) and (*b*) schematically show a relationship between the contact angle of the cleaning blade to the transparent window and the position of the low rigidity portion of the cleaning blade in embodiment 1.
Figure 9:
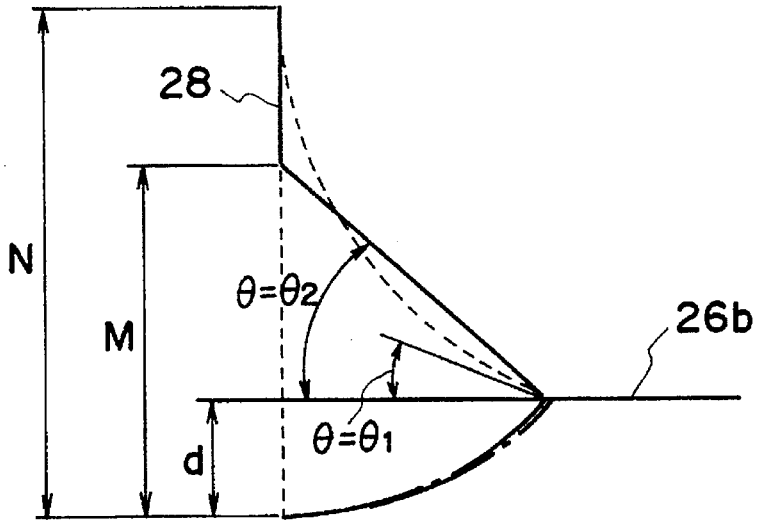

FIGS. 9(*a*) and 9(*b*) illustrate a relation among the position of the low rigidity portion of the cleaning blade, the free length N of the cleaning blade and the entrance amount d of the cleaning blade to the window surface. If it is assumed that the deformation of the cleaning blade occurs only at the low rigidity portion, the contact angle $\theta$ is equal to the contact angle without the low rigidity portion (FIG. 9 (*a*)), when the positional relation between the cleaning blade and the transparent window is the same, and the distance m from the end of the cleaning blade and the low rigidity portion satisfies:

$$\frac{d(2m-d)}{(m-d)^2} = \tan^2 \frac{N(2dm-d^2)^{1/2}}{m(N-d)}$$

Therefore, the contact angle θ can be increased (θ2>θ1) without changing the entrance amount d by making a distance M from the end of the cleaning blade to the low rigidity portion larger than the m satisfying the above equation. Additionally, when a contact angle equal to that without the provision of the low rigidity portion in the cleaning blade is to be obtained, the entrance amount d can be increased by making the distance M beyond m.

Figure 10:
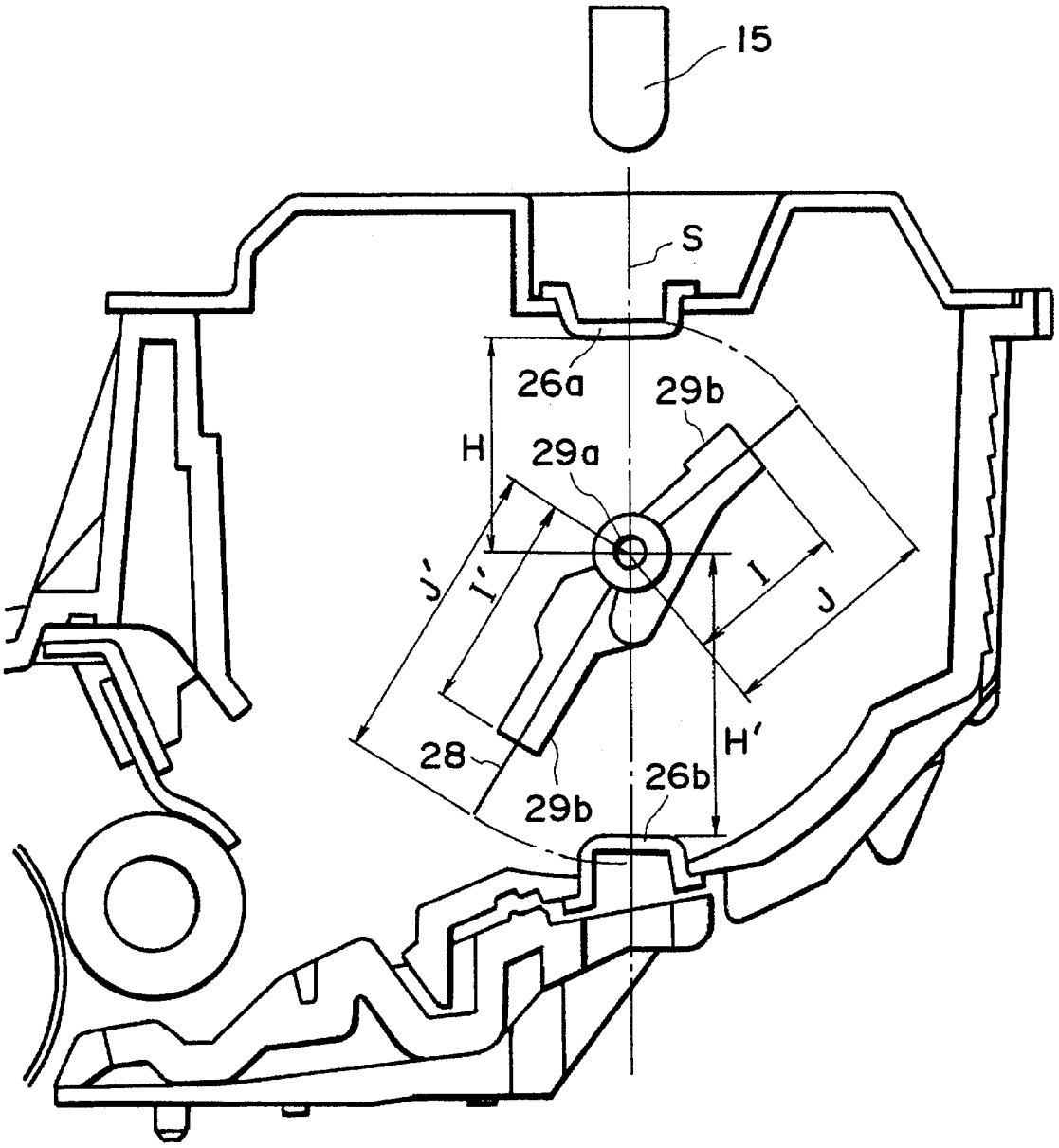
FIG. 10 shows a relationship among stirring blades, the transparent windows and the cleaning blade in embodiment 1.

Referring to FIG. 10, a description will be made as to the relation among the light emitting element 15, light receiving element 16, transparent window 26*a*, transparant window 26*b*, and cleaning member 29. As described in the foregoing, the light emitting element 15 and light receiving element 16 are mounted to the main assembly 1 so that they are facing each other with the developer container 25 therebetween when the process cartridge 20 is mounted to the main assembly 1. The shaft 29*a* of the cleaning member is located adjacent the optical axis S, preferably, across the optical axis S. The transparent window 26*a* and transparant window 26*b* are facing the transparent window 26*b* and transparant window 26*a*, respectively, and the transparent window 26*a* and transparant window 26*b* are positioned so that they are contacted by the cleaning member moving along a circumference of a circle about the shaft 29*a*. Therefore, the angle formed between the window surface and the optical axis S is very close to 90 degrees. Thus, the sizes of the transparent window 26*a* and transparant window 26*b* can be minimized as compared with a slanted window surface relative to the optical axis S. This is effective to minimize deterioration of the image quality and deterioration of the photosensitive drum 21 and the developer T attributable to the astray light.

Additionally, the optical path length through the material of the window is shorter than that in the case of the slanted window, and therefore, the loss of light energy due to absorption, scattering, or the like by the material of the window can be suppressed. The 90 degree incidence of the light from the light emitting element 15 can suppress the loss of light energy due to reflection of the light by the surface. This eliminates the necessity to use a light emitting element of high intensity and wide directivity or to use a high sensitivity light receiving element, thus reducing the cost of the apparatus. These advantages are most effective when the shaft 29*a* across the optical axis S is positional so that window surfaces of the transparent window 26*a* and transparant window 26*b* are perpendicular to the optical axis S.

A distance H between the top transparent window 26*a* and the shaft 29*a* of the cleaning member, a distance I between the top end 29*b* of the cleaning member and the shaft 29*a* and a distance J between the top end to the cleaning blade 28 and the shaft 29*a*, satisfy I<H<J, as shown in FIG. 10. A distance H' between the bottom transparent window 26*a* and the shaft 29*a* of the cleaning member, a distance I' between the bottom end 29*b* of the cleaning member and the shaft 29*a* and a distance J' between the bottom end to the cleaning blade 28 and the shaft 29*a*, satisfy I'<H'<J', as shown in FIG. 10. Therefore, by the swinging motion of the cleaning member 29, the cleaning blade 28 is contacted to the window surfaces of the transparent window 26*a* and transparant window 26*b* while it swings, to wipe developer T off the window surfaces thereof. Since the window surfaces are in contact with a circle having a center at the cleaning member 29 at this time, the transparent window 26*a* and transparant window 26*b* can be cleaned uniformly.

According to this embodiment, even if the size of cleaning member 29 is decreased for the purpose of downsizing the process cartridge 20 or for flattening the developer container 25, the contact angle can be maintained without reducing the entrance amount d by the same ratio. It is also possible to maintain resistance against deformation of the cleaning blade 28, and the the transparent window can be effected cleaned without increasing the driving torque and without deteriorating the image quality. It is not necessary to handle a thin and small blade so that the assembling of the apparatus is easy, and the number of the blade mounting steps can be reduced, thus reducing the manufacturing cost.

Figure 11:
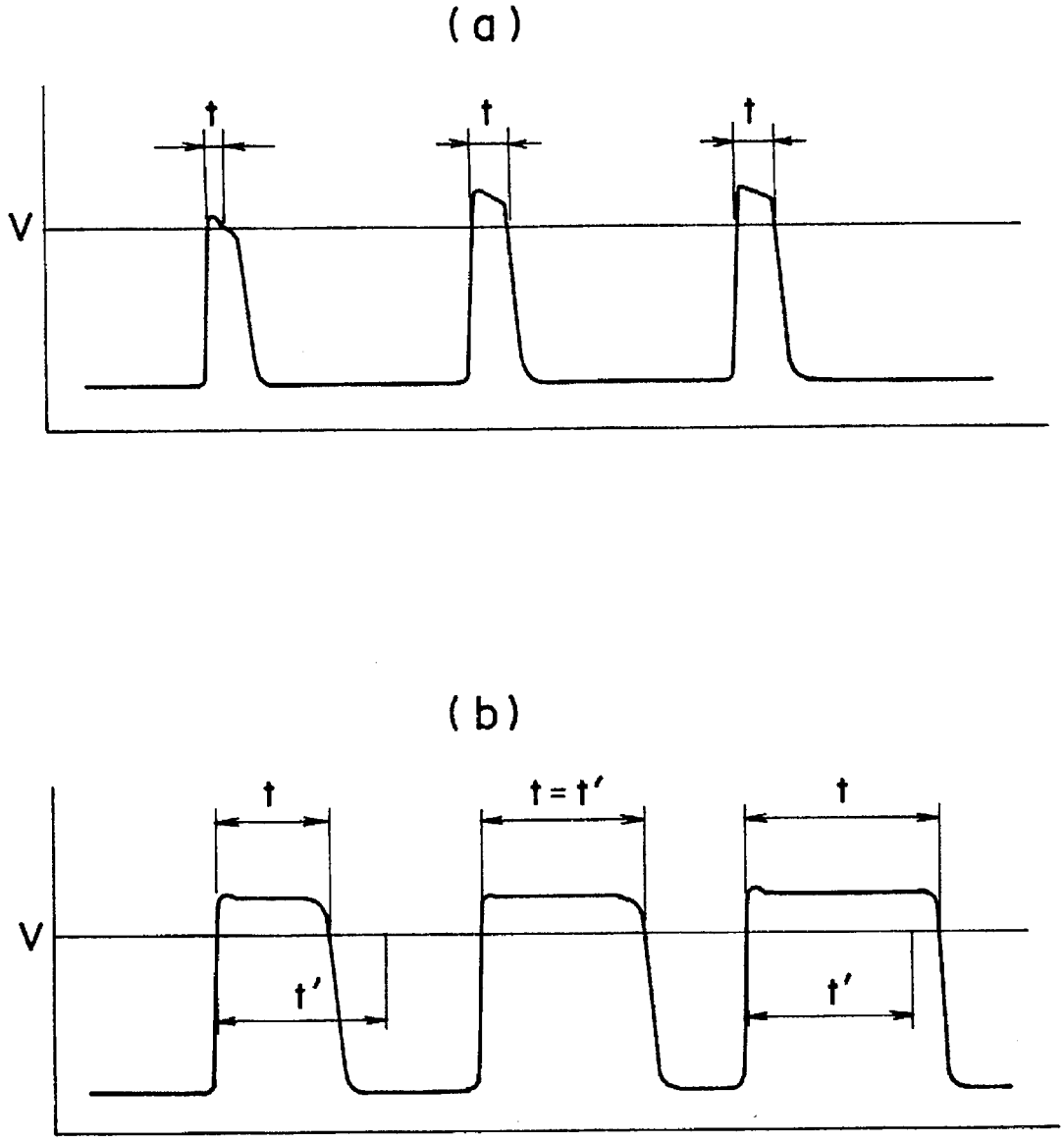
FIGS. 11(*a*) and (*b*) schematically show an output signal of a light receiving element in embodiment 1.

In the above-described image forming operation, cleaning member 29 rotates so that the cleaning blade 28 removes developer T from the transparent window 26*a* and transparant window 26*b*. When the amount of developer T is sufficient, the developer T re-covers the window surfaces immediately after the cleaning blade 28 removes the developer T from the transparent window 26*a* and transparant window 26*b*, and therefore, the light from the light emitting element 15 does not reach the light receiving element 16, or even if it does reach the light receiving element 16, the light beam is quickly re-blocked. If, however, the amount of the developer T decreases, then the time required for the developer T to re-cover the transparent window 26*a* and transparant window 26*b* is reduced. When the developer T is used up, then the light continuously reaches the light receiving element 16 except when the transparant window 26*b* and the cleaning blade 28 cross the optical path R, FIG. 11 shows the output signals from the light receiving element 16, wherein the coordinate axis represents the output and the abscissa represents time. When the light from the light emitting element 15 reaches the light receiving element 16, the output of the light receiving element 16 increases. The output signal of the light receiving element 16 takes alternately a high level and low level (saw teeth). With a sufficient amount of developer T present, the time period of the high level is short (FIG. 11(*a*)), but with a decreased amount of developer T present, the time period thereof becomes longer (FIG. 11(*b*). The time period t for which the level is higher than a predetermined level V is detected, and the absence of the developer T is determined when the period t is longer than a predetermined period t'.

As described in the foregoing, the cleaning blade of a flexible material is provided with an opening, so that the rigidity of the cleaning blade is maintained low, and simultaneously, deformation of the cleaning blade is concentrated on a predetermined position, by which even if the size of the cleaning member is reduced, the contact angle of the cleaning blade can be made larger without reducing the entrance amount of the cleaning blade.

Embodiment 2

Figure 12:
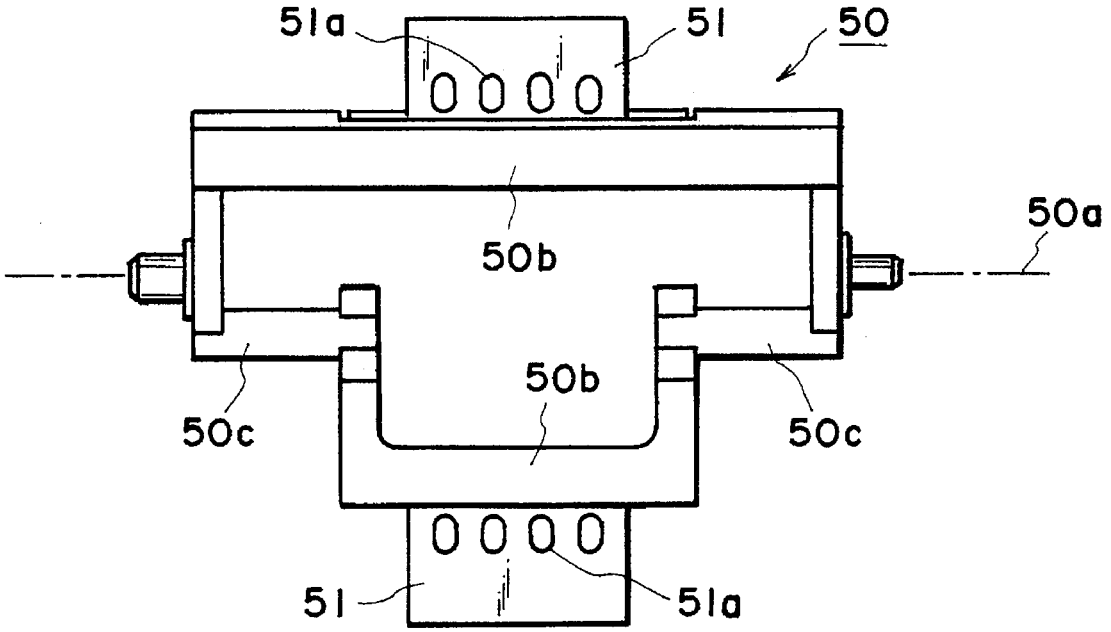
FIG. 12 shows a cleaning member in embodiment 2.

Referring to FIG. 12, the second embodiment of the present invention will be described. FIG. 12 is a front view of a cleaning member used in this embodiment. In this embodiment, the transparent window is cleaned by a plurality of cleaning blades 51, and each of the cleaning blades 51 has at least one opening 51*a*. Designated by a reference numeral 50*a* is a rotational shaft for the cleaning member, and 50*c* is a driving shaft of the cleaning member. This embodiment is the same as the foregoing embodiment in other respects.

The cleaning member 50 is used in place of the cleaning member 29, by which the driving shaft 50*c* receives a driving force from the rib 27*c* of the stirring blade 27, so that the cleaning member 50 swings about the rotational shaft 50*a* to clean the transparent window 26*a* and transparant window 26*b*.

By provision of the opening 51*a*, the cleaning blade deforms significantly adjacent the opening 51*a*, and the deformation of the other portion is not significant. The provision of the opening 51*a* effectively decreases the rigidity of the cleaning blades 51.

By changing the size, number and/or positions of the openings 51*a*, the rigidity of each cleaning blade and the contact angle between the edge of the cleaning blades 51 and the transparent window 26*a* or transparant window 26*b* can be properly selected as in embodiment 1. As a result, the same advantageous effects as in embodiment 1 can be provided even if the free length of the cleaning blade 51 is increased.

Embodiment 3

Figure 13:
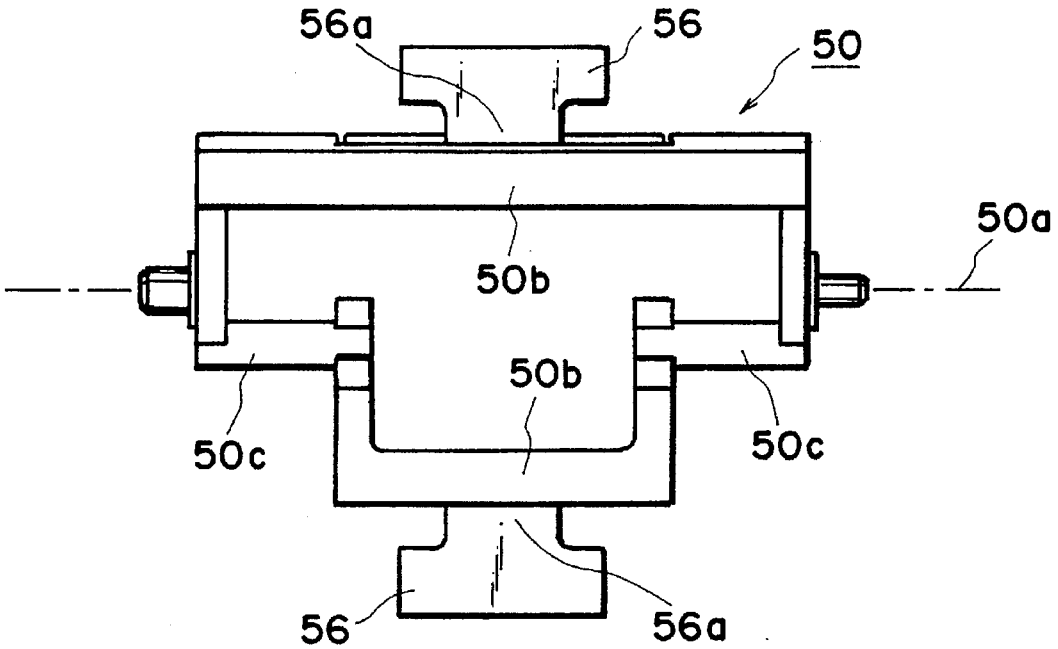
FIG. 13 shows a cleaning member in embodiment 3.

Referring to FIG. 13, a third embodiment of the present invention will be described. As shown in FIG. 13, a cleaning blade 56 contains a narrow portion 56*a* in place of the cleaning blade 51 of the foregoing embodiment. The structures of this embodiment are the same as embodiment 2 in the other respects.

By the provision of the narrow portion 56*a*, the cleaning blade significantly deforms adjacent the narrow portion 56*a*, and the deformation of the other portion is not significant. The provision of the narrow portion 56*a* is also effective to decrease the rigidity of the cleaning blade 56.

By changing the width, length and/or position of the narrow portion 56*a*, the rigidity of the cleaning blade and the contact angle between the edge of the cleaning blade 56 and the transparent window 26*a* or transparant window 26*b* can be properly selected as in embodiment 1. As a result, the same advantageous effects as in embodiment 1 can be provided even if the free length of the cleaning blade 56 is increased.

Embodiment 4

Figure 14:
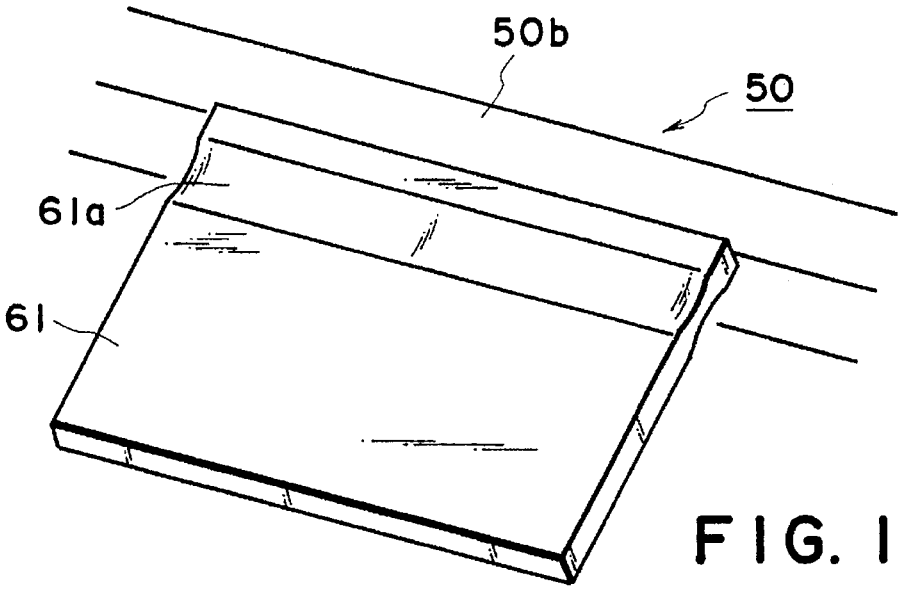
FIG. 14 shows a cleaning member in embodiment 4.

Referring to FIG. 14, a description will be made as to a fourth embodiment, wherein a cleaning blade 61 having a partially thin portion is used in place of the cleaning blades 51 in embodiment 2. The cleaning blade 61 mounts to an end 50*b* of the cleaning member 50 and is provided with a thin portion 61*a* parallel to the rotational shaft 50*a* for the unshown cleaning member. The structures of this embodiment are the same as the second embodiment in other respects.

By the provision of a thin portion 61*a*, the cleaning blade deforms significantly at the thin portion 61*a*, and the other portion does not deform significantly. By providing a thin portion 61*a*, the rigidity of the cleaning blade 61 becomes small.

By changing the width, thickness and/or position of the thin portion 61*a*, the rigidity of the cleaning blade, and the contact angle between the edge of the cleaning blade 61 and the transparent window 26*a* or transparent window 26*b*, can be properly selected as in embodiment 1. As a result, the same advantageous effects as in embodiment 1 can be provided even if the free length of the cleaning blade 61 is increased.

Embodiment 5

Figure 15:
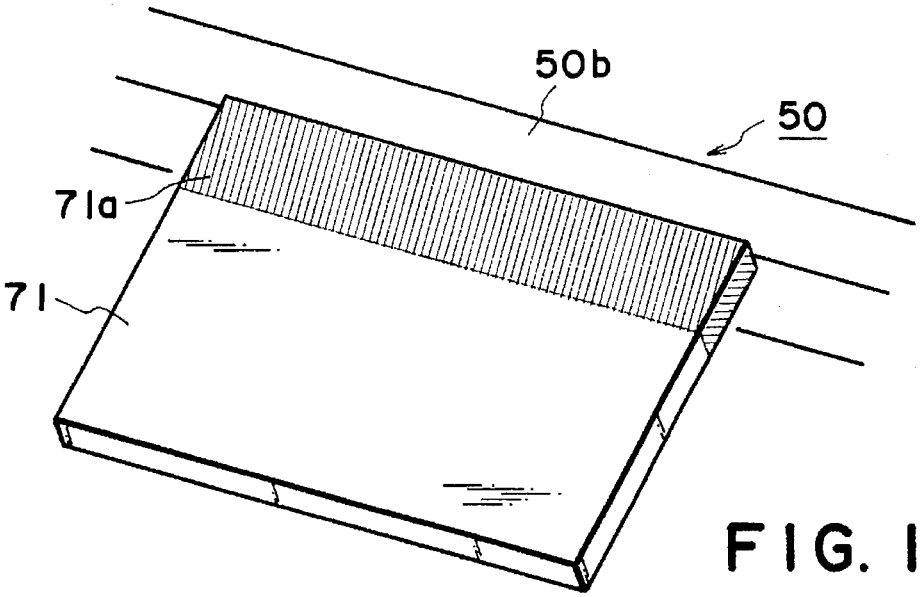
FIG. 15 shows a cleaning member in embodiment 5.

Referring to FIG. 15, a description will be made as to a fifth embodiment, wherein a cleaning blade 71 having a partial different material portion is used in place of the cleaning blades 51 in embodiment 2. The cleaning blade 71 mounted to an end 50*b* of the cleaning member 50 is provided with a portion composed of a material having a low rigidity at a base portion 71*a* of the cleaning blade. The interface between the different material portions is preferably extended substantially in parallel with the rotational shaft 50*a*. The other structures of this embodiment are the same as those of the embodiment 2.

Because of this structure, the cleaning blade deforms Significantly adjacent the base portion of the cleaning blade, and the deformation of the other portion is not significant. In addition, the rigidity of the cleaning blade 71 is small.

By changing the material of the base portion of the cleaning blade, the rigidity of the cleaning blade, and the contact angle between the edge of the cleaning blade 71 and the transparent window 26*a* or transparant window 26*b*, can be properly selected as in embodiment 1. As a result, the same advantageous effects as in embodiment 1 can be provided even if the free length of the cleaning blade 71 is increased. The cleaning blade can be made by bonding different materials together or by two-color molding.

Embodiment 6

Figure 16:
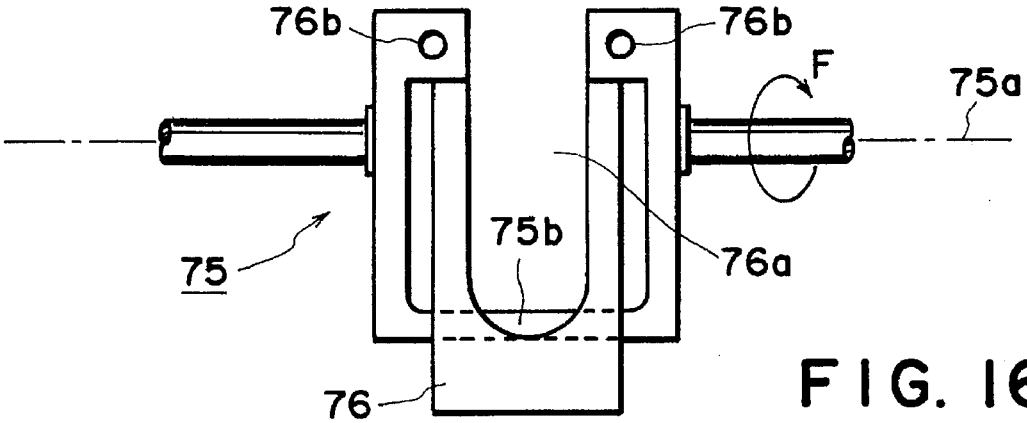
FIG. 16 shows a cleaning member in embodiment 6.
Figure 17:
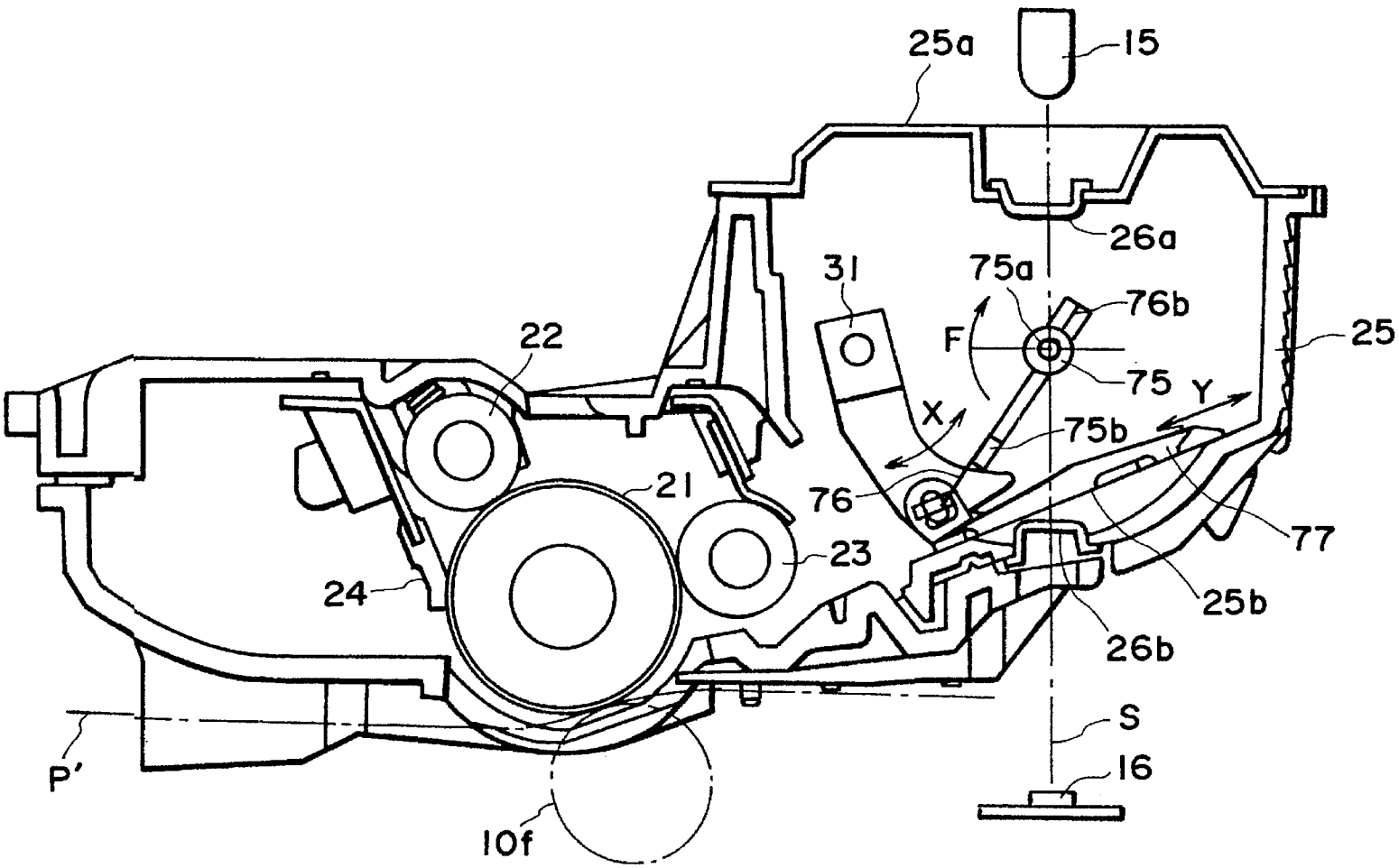
FIG. 17 is a longitudinal sectional view of a process cartridge in embodiment 6.

Referring to FIGS. 16 and 17, a description will be made as to embodiment 6. FIGS. 16 and 17 are a front view of the cleaning member of this embodiment and a longitudinal sectional view of a process cartridge of this embodiment, respectively. A cleaning blade 76 is fixed to a cleaning member 75 at an end 76*b*, and is supported by the end 75*b* of the cleaning member. The cleaning blade is provided with an opening 76*a*. The cleaning member 75 rotated by an unshown driving source about a shaft 75*a* in a direction F to clean the transparent window 26*a* and transparant window 26*b*. A stirring blade 77 feeds the developer T into a developing chamber through a mechanism as in embodiment 1. The structures of this embodiment are the same as in embodiment 1 in the other respects.

By the provision of the opening 76*a*, the cleaning blade deforms significantly adjacent to the opening 76*a*, and the deformation of the other portion is not significant. The provision of the opening 76*a* is effective to decrease the rigidity of the cleaning blade 76.

By changing the configuration of the opening 76*a*, the rigidity of the cleaning blade, and the contact angle between the edge of the cleaning blade 76 and the transparent window 26*a* or transparant window 26*b*, can be properly selected as in embodiment 1. As a result, the same advantageous effects as in embodiment 1 can be provided even if the free length of the cleaning blade 76 is increased.

In this embodiment, the fixed portion 76*b* of the cleaning blade 76 is located away from the edge of the cleaning blade beyond the rotational axis 75*a* of the cleaning member, with the result of a longer free length. The fixed position 76*b* may be between the rotational axis of the cleaning member and the end of the cleaning blade or at the rotational center of the cleaning member.

Similar to embodiment 1, embodiments 2–6 satisfy the following:

$$\frac{d(2m-d)}{(m-d)^2} = \tan^2 \frac{N(2dm-d^2)^{1/2}}{m(N-d)}$$

In Embodiments 1–6, the presence or absence of the developer T is detected by a light transmission type sensor, but a reflection type sensor is usable wherein the presence or absence of the developer T is detected by a difference in reflectance by the member (Toner) in the process cartridge. In such a case, only one transparent window is provided, and the cleaning member 80 cleans only one window 26*b*.

Embodiment 7

Figure 19:
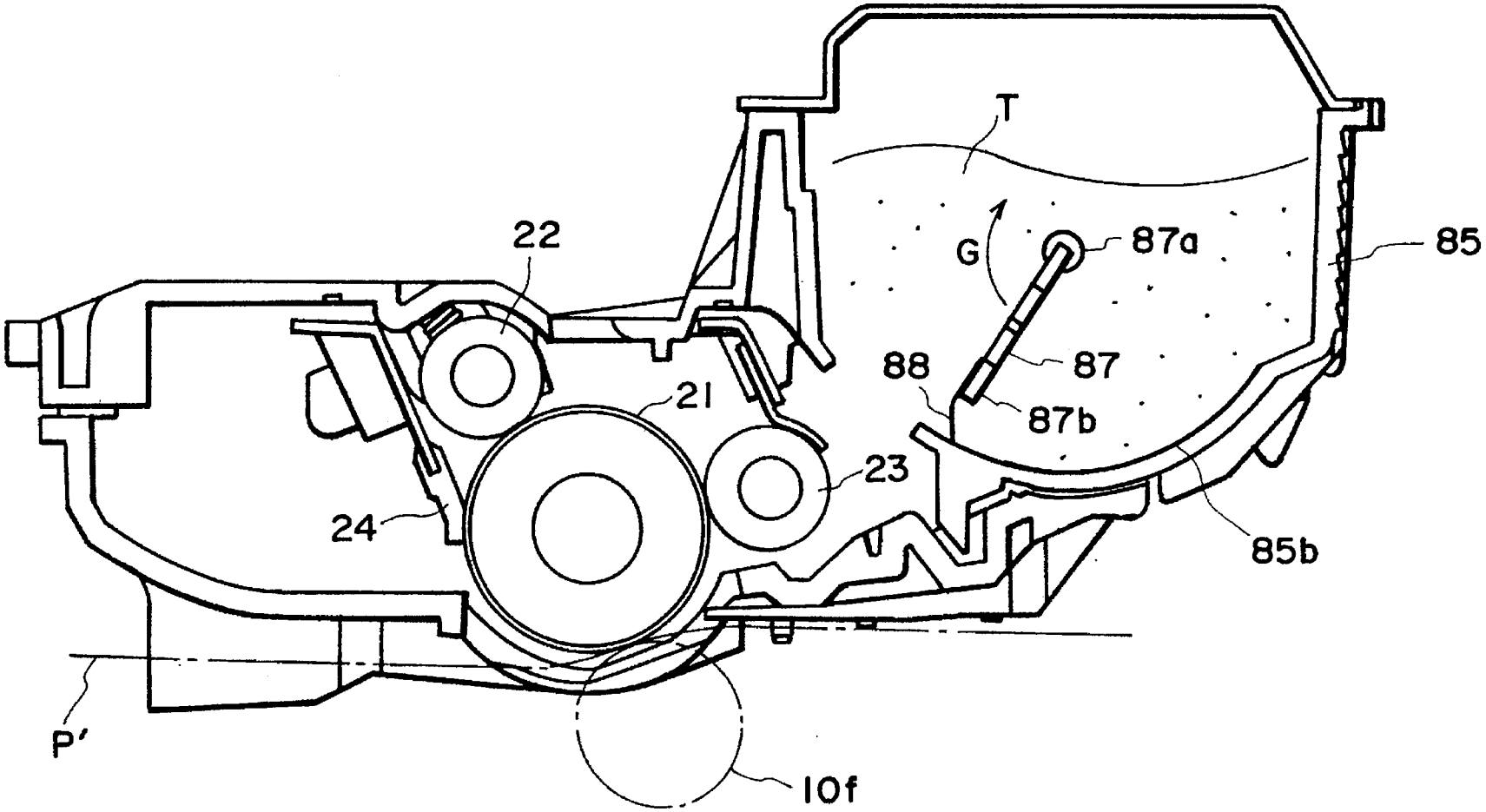
FIG. 19 is a longitudinal sectional view of a process cartridge in embodiment 7.
Figure 20:
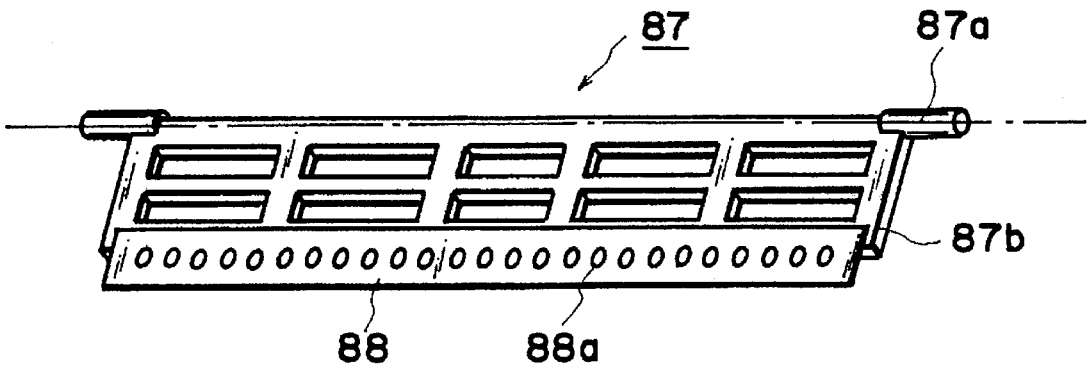
FIG. 20 is a perspective view of stirring blades in embodiment 7.

Referring to FIGS. 19 and 20, embodiment 7 will be described, wherein the toner scraping cleaning blade of this invention also is used for developer feeding blade.

FIG. 19 is a sectional view of a process cartridge according to this embodiment, and FIG. 20 is a perspective view of a stirring means which is a developer feeding means in this embodiment. Designated by 87 is a stirring blade, which is rotated in a direction G about a shaft 87*a* to feed the developer T into a developing chamber and to accomplish uniform distribution of the developer T. The bottom wall 85*b* of the developer container 85 is formed into a cylindrical shape relative to a center of the shaft 87*a*. A flexible blade 88 for feeding the developer T is mounted to the end 87*b* of the blade. With the rotation of the blade 87, the feeding blade 88 rotates while being in contact with the bottom wall 85 of the developer container to scrape developer T deposited on the bottom wall 85*b* of the developer container and feed it to the developing chamber.

The blade 88 is provided with a plurality of openings 88*a* at regular intervals in parallel with the shaft 87*a* of the stirring blade. The distance between the end of the feeding blade and the low rigidity portion is larger than m satisfying the following:

$$\frac{d(2m-d)}{(m-d)^2} = \tan^2 \frac{N(2dm-d^2)^{1/2}}{m(N-d)}$$

where N is a free length of the feeding blade, and d is an entrance amount of the feeding blade into the bottom wall 85*b* of the developer container.

According to this embodiment, even in the size of the blade 87 is reduced, the contact angle between the feeding blade and the developer container can be properly selected without the necessity of reducing the entrance amount d correspondingly at proportional ratio. Therefore, the developer T can be fed to the developer chamber to the final end so that the process cartridge can be downsized while maintaining the conventional developer feeding performance.

While the invention has been described with reference to the structures disclosed herein, it is not confined to the details set forth and this application is intended to cover such modifications or changes as may come within the purposes of the improvements or the scope of the following claims.

What is claimed is:

1. A developing apparatus comprising:

a developer container for containing a developer;

a light transmitting portion in said developer container, for optically detecting the developer; and a rotatable wiping sheet for wiping said light transmitting portion;

wherein said wiping sheet has a low rigidity portion at a rotational axis side beyond a wiping end of said wiping sheet, and wherein the low rigidity portion of said wiping sheet includes an opening therein.

2. An apparatus according to claim 1, wherein the opening transmits light for developer detection.

3. A developing apparatus comprising:

a developer container for containing a developer;

a light transmitting portion in said developer container, for optically detecting the developer; and a rotatable wiping sheet for wiping said light transmitting portion;

wherein said wiping sheet has a low rigidity portion at a rotational axis side beyond a wiping end of said wiping sheet, and wherein low rigidity portion said wiping sheet includes a narrow portion formed therein.

4. A developing apparatus comprising:

a developer container for containing a developer;

a light transmitting portion, in said developer container, for optically detecting the developer; and a rotatable wiping sheet for wiping said light transmitting portion;

wherein said wiping sheet has a low rigidity portion at a rotational axis side beyond a wiping end of said wiping sheet, and wherein a first distance m initially exists between an end of said wiping sheet and the position of the low rigidity portion, a second distance M is established between an end of said wiping sheet and the position of the low rigidity portion for increasing the contact angle between said wiping sheet and said light transmitting portion, a length N between a supporting position of said wiping sheet and an end thereof, and an entrance amount d of said wiping sheet into the light transmitting portion, satisfy:

$$M > m, \text{ and}$$

$$\frac{d(2m-d)}{(m-d)^2} = \tan^2 \frac{N(2dm-d^2)^{1/2}}{m(N-d)} .$$

5. An image forming apparatus comprising:

an image bearing member for bearing an electrostatic image;

developing means for developing the electrostatic image on said image bearing member, said developing means including a developer container for containing a developer; a light transmitting portion, in said developer container, for optically detecting the developer; and a rotatable wiping sheet for wiping said light transmitting portion; wherein said wiping sheet has a low rigidity portion at a rotational axis side beyond a wiping end of said wiping sheet, on an optical axis for detecting the developer through said light transmitting portion, wherein the low rigidity portion of said wiping sheet includes an opening therein; and an optical element for detecting a developer through said light transmitting portion.

6. An apparatus according to claim 5, wherein the opening transmits light for developer detection.

7. An image forming apparatus comprising:

an image bearing member for bearing an electrostatic image;

developing means for developing the electrostatic image on said image bearing member, said developing means including a developer container for containing a developer; a light transmitting portion, in said developer container, for optically detecting the developer; and a rotatable wiping sheet for wiping said light transmitting portion; wherein said wiping sheet has a low rigidity portion at a rotational axis side beyond a wiping end of said wiping sheet, on an optical axis for detecting the developer through said light transmitting portion, wherein the low rigidity portion of said wiping sheet includes a narrow portion formed therein; and an optical element for detecting a developer through said light transmitting portion.

8. An image forming apparatus comprising:

an image bearing member for bearing an electrostatic image;

developing means for developing the electrostatic image on said image bearing member, said developing means including a developer container for containing a developer; a light transmitting portion, in said developer container, for optically detecting the developer; and a rotatable wiping sheet for wiping said light transmitting portion; wherein said wiping sheet has a low rigidity portion at a rotational axis side beyond a wiping end of said wiping sheet, on an optical axis for detecting the developer through said light transmitting portion; and an optical element for detecting a developer through said light transmitting portion, wherein a first distance m initially exists between an end of said wiping sheet and the position of the low rigidity portion, a second distance M is established between an end of said wiping sheet and the position of the low rigidity portion for increasing the contact angle between said wiping sheet and said light transmitting portion, a length N between a supporting position of said wiping sheet and an end thereof, and an entrance amount d of said wiping sheet into the light transmitting portion, satisfy:

$$M > m, \text{ and}$$

$$\frac{d(2m-d)}{(m-d)^2} = \tan^2 \frac{N(2dm-d^2)^{1/2}}{m(N-d)} .$$

9. An apparatus according to any one of claims 5, 7 and 8, wherein said developing means is detachably mountable to a main assembly of said apparatus.

10. An apparatus according to claim 9, wherein said developing means is structurally connected with said image bearing member to constitute a cartridge.

11. An apparatus according to any one of claims 5, 7 and 8, wherein said apparatus detects a presence or absence of the developer on the basis of an output of said optical element.

12. An apparatus according to any one of claims 5, 7 and 8, wherein said optical element emits light toward the light transmitting portion.

13. An apparatus according to any one of claims 5, 7 and 8, wherein said optical element receives light from the light transmitting portion.

14. A developing apparatus comprising:

a developing device having an opening and a developer carrying member for carrying a developer;

a developer container, adjacent said developing device, for containing a developer; and a rotatable rubbing sheet for rubbing an internal surface of said developer container to feed the developer from said developer container to said developing device;

wherein said rubbing sheet has a low rigidity portion at a rotational axis side beyond a wiping end of said wiping sheet, and wherein the low rigidity portion of said rubbing sheet includes an opening formed therein.

15. A developing apparatus comprising:

a developing device having an opening and a developer carrying member for carrying a developer;

a developer container, adjacent said developing device for containing a developer; and a rotatable rubbing sheet for rubbing an internal surface of said developer container to feed the developer from said developer container to said developing device;

wherein said rubbing sheet has a low rigidity portion at a rotational axis side beyond a wiping end of said rubbing sheet, and wherein the low rigidity portion of said rubbing sheet includes a narrow portion formed therein.

16. A developing apparatus comprising:

a developing device having an opening and a developer carrying member for carrying a developer;

a developer container, adjacent said developing device, for containing a developer; and a rotatable rubbing sheet for rubbing an internal surface of said developer container to feed the developer from said developer container to said developing device;

wherein said rubbing sheet has a low rigidity portion at a rotational axis side beyond a wiping end of said wiping sheet, and wherein a first distance m initially exists between an end of said wiping sheet and the position of the low rigidity portion, a second distance M is established between an end of said rubbing sheet and the position of the low rigidity portion for increasing the contact angle between said wiping sheet and said light transmitting portion, a length N between a supporting position of said rubbing sheet and an end thereof, and an entrance amount d of said rubbing sheet into the light transmitting portion, satisfy:

$$M > m, \text{ and}$$

$$\frac{d(2m-d)}{(m-d)^2} = \tan^2 \frac{N(2dm-d^2)^{1/2}}{m(N-d)} .$$

* * * * *

UNITED STATES PATENT AND TRADEMARK OFFICE

CERTIFICATE OF CORRECTION

PATENT NO. : 5,655,175

DATED : Aug. 5, 1997

INVENTOR(S) : OSHIDA

It is certified that error appears in the above-identified patent and that said Letters Patent is hereby corrected as shown below:

Column 1

Line 65, "Cost" should read --cost--.

Column 2

Line 1, delete "the" (first occurrence);
Line 14, delete "the" (second occurrence); and
Line 16, delete "the" (first occurrence).

Column 4

Line 12, "The" should read --¶ The--;
Line 62. "transparant" should read --transparent--; and
Line 64, delete "the" (second occurrence).

Column 5

Line 5, "feeds" should read --feed--;
Line 19, delete "to";
Line 22, "transparant" should read --transparent--;
Line 25, "transparant" should read --transparent--;
Line 56, "transparant" should read --transparent--; and
Line 58, "to shaft" should read --to a shaft--.

Column 6

Line 11, delete "the" (second occurrence);
Lines 38-39, "need increasing" should read --need to increase--;
Line 48, "shown" should read --as shown--; and
Line 54, delete "the".

UNITED STATES PATENT AND TRADEMARK OFFICE

CERTIFICATE OF CORRECTION

PATENT NO. : 5,655,175

DATED : Aug. 5, 1997

INVENTOR(S) : OSHIDA

It is certified that error appears in the above-identified patent and that said Letters Patent is hereby corrected as shown below:

Column 7

Line 16, "transparant" should read --transparent--;
Line 24, "transparant" should read --transparent--;
Line 25, "transparant" should read --transparent--;
Line 27, "transparant" should read --transparent--;
Line 32, "transparant" should read --transparent--;
Line 50, "transparant" should read --transparent--; and
Line 65, "transparant" should read --transparent--.

Column 8

Line 2, "transparant" should read --transparent--;
Line 9, "the the" should read --the--;
Lines 9-10, "effected cleaned"should read --effectively--;
Lines 17-18, "transparant should read --transparent--;
Line 19, delete "the" (first occurrence);
Line 21, "transparant" should read --transparent--;
Lines 27-28, "transparant" should read --transparent--; and
Line 30, "transparant" should read --transparent--.

Column 9

Line 3, "transparant" should read --transparent--;
Line 14, "transparant" should read --transparent--;
Line 25, delete "the"; and
Line 35, "transparant" should read --transparent--.

UNITED STATES PATENT AND TRADEMARK OFFICE

CERTIFICATE OF CORRECTION

PATENT NO. : 5,655,175

DATED : Aug. 5, 1997

INVENTOR(S) : OSHIDA

It is certified that error appears in the above-identified patent and that said Letters Patent is hereby corrected as shown below:

Column 10

Line 11, "Significantly" should read --significantly--; and
Line 18, "transparant" should read --transparent--;
Line 33, "75 rotated" should read --75 is rotated--;
Line 36, "transparant" should read --transparent--; and
Line 48, "transparant" should read --transparent--.

Column 11

Figure 18:
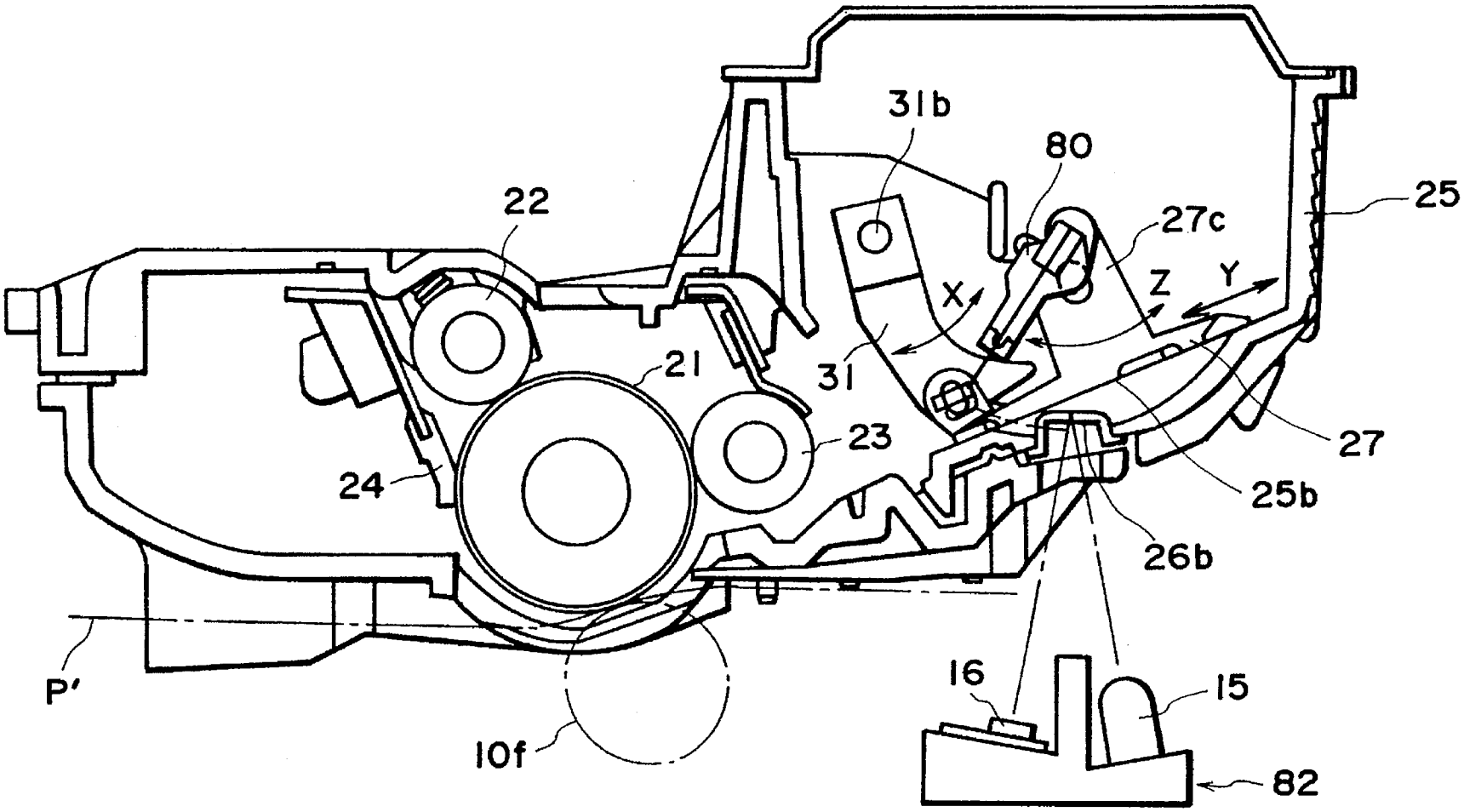
FIG. 18 is a longitudinal sectional view of a process cartridge in embodiment 6.

Line 3, "(Toner)" should read --(toner)--; and
Line 4, "case, only" should read --case as shown in Fig. 18,--; and
Line 39, "in" should read --if--.

Signed and Sealed this

Second Day of June, 1998

Bruce Lehman

BRUCE LEHMAN

*Commissioner of Patents and Trademarks*

*Attest:*

*Attesting Officer*